United States Patent [19]

Stock et al.

[11] 3,932,979

[45] Jan. 20, 1976

[54] APPARATUS FOR INSERTING CLOSURE MEANS INTO A CONTAINER

[75] Inventors: Arthur J. Stock, Lakewood; Donald E. Christofer, Willowick; Joseph E. Brinza, Euclid, all of Ohio

[73] Assignee: Stock Equipment Company, Chagrin Falls, Ohio

[22] Filed: Oct. 25, 1973

[21] Appl. No.: 409,397

Related U.S. Application Data

[62] Division of Ser. No. 182,088, Sept. 20, 1971, Pat. No. 3,835,617.

[52] U.S. Cl. ..... 53/76; 53/86; 53/281; 53/331.5; 53/381 A

[51] Int. Cl.². B65B 43/40; B65B 7/28; B65B 57/02

[58] Field of Search ..... 53/331.5, 381 A, 281, 76, 53/86, 97, 101, 102, 109, 318, 67, 69

[56] References Cited

UNITED STATES PATENTS

| | | | |
|---|---|---|---|
| 1,451,351 | 4/1923 | Van Doren | 53/367 X |
| 1,941,195 | 12/1933 | Anderson | 53/101 X |
| 2,731,185 | 1/1956 | Ranney et al. | 53/367 UX |
| 3,307,322 | 3/1967 | Jones | 53/67 |
| 3,541,755 | 11/1970 | Bobrakov et al. | 53/109 X |
| 3,765,146 | 10/1973 | Ghiretti | 53/67 |

*Primary Examiner*—Travis S. McGehee
*Assistant Examiner*—Horace M. Culver
*Attorney, Agent, or Firm*—Bosworth, Sessions & McCoy

[57] ABSTRACT

Apparatus is disclosed for disposing of radioactive waste materials by placing them into a steel drum together with cement and water, mixing the contents, and then storing the drum for a period of time to permit partial decay of radioactive materials. Also disclosed are remotely controlled apparatus for filling, closing and agitating the drum including special means for unscrewing a cap from the drum, for holding the cap during filling, and for replacing the cap after filling.

25 Claims, 9 Drawing Figures

336
337
338
320
333
349
348
350b
341
394
343
350
331
346
332
231
350a
329
330
C
347
326
322
226
D
327
325
324
323
328
321
334
335
261b
261a
261

APPARATUS FOR INSERTING CLOSURE MEANS INTO A CONTAINER

REFERENCE TO RELATED APPLICATION

This application is a division of our co-pending allowed application Ser. No. 182,088 filed Sept. 20, 1971, and now U.S. Pat. No. 3,835,617, which is incorporated herein by reference.

BACKGROUND OF THE INVENTION

This invention relates to remotely controlled apparatus for disposition of radioactive waste material as produced, for example, in nuclear electric power generating stations, and more particularly to capping apparatus for removing and replacing the caps on containers for such radioactive material.

Stringent laws, rules and regulations govern the disposition of radioactive wastes and their transportation over highways, on railroads and by other modes of transportations. In general, the material must be shielded so that radiations emanating from the material do not exceed maximum levels established by the laws and regulations. Furthermore, it is desired that in a case of an accident causing dumping of a radioactive load, there should be no fluidic materials that can penetrate the ground or mix with streams or ground water and cause radioactive contamination. It has therefore been proposed to provide a mixture of resin particles containing radioactive material, cement as a solidifying agent, and water in a container such as a steel drum, and to allow the mixture to solidify in the drum.

However, prior systems for putting radioactive materials into a drum or other container in general require that operators and maintenance personnel be exposed to radiation, even though such system may be intended to protect personnel. For example, the operators in many cases must go into areas containing radiation to open drums or close them or to insert nozzles in the drums or to handle the drums in storage. In some systems an operator may stand behind a shield wall, but must extend his arms into a radioactive zone, and expose his head to see.

SUMMARY OF THE INVENTION

It is a general object of the present invention to overcome the above and other problems relating to the disposition of radioactive waste materials and to provide an apparatus controlled from a remote location for unscrewing and replacing the closure cap of a drum or other container.

In accordance with the invention, there is provided a housing for receiving a drum having a removable closure cap, means for accurately guiding the drum to a predetermined filling position, a releasable wrench means mounted on the upper part of the housing and movable axially to a position for gripping the cap, and means controllable from a remote location for moving said wrench means to such gripping position and for rotating the wrench means to screw or unscrew the closure caps, the axial movement of the wrench means per revolution corresponding to the pitch of the threads on the closure cap.

BRIEF DESCRIPTION OF THE DRAWINGS

These and other objects and features of the invention will be apparent from the following description of a preferred embodiment of the invention in connection with the accompanying drawings in which.

DISCLOSURE OF PREFERRED EMBODIMENT

General Arrangement

Figure 1:
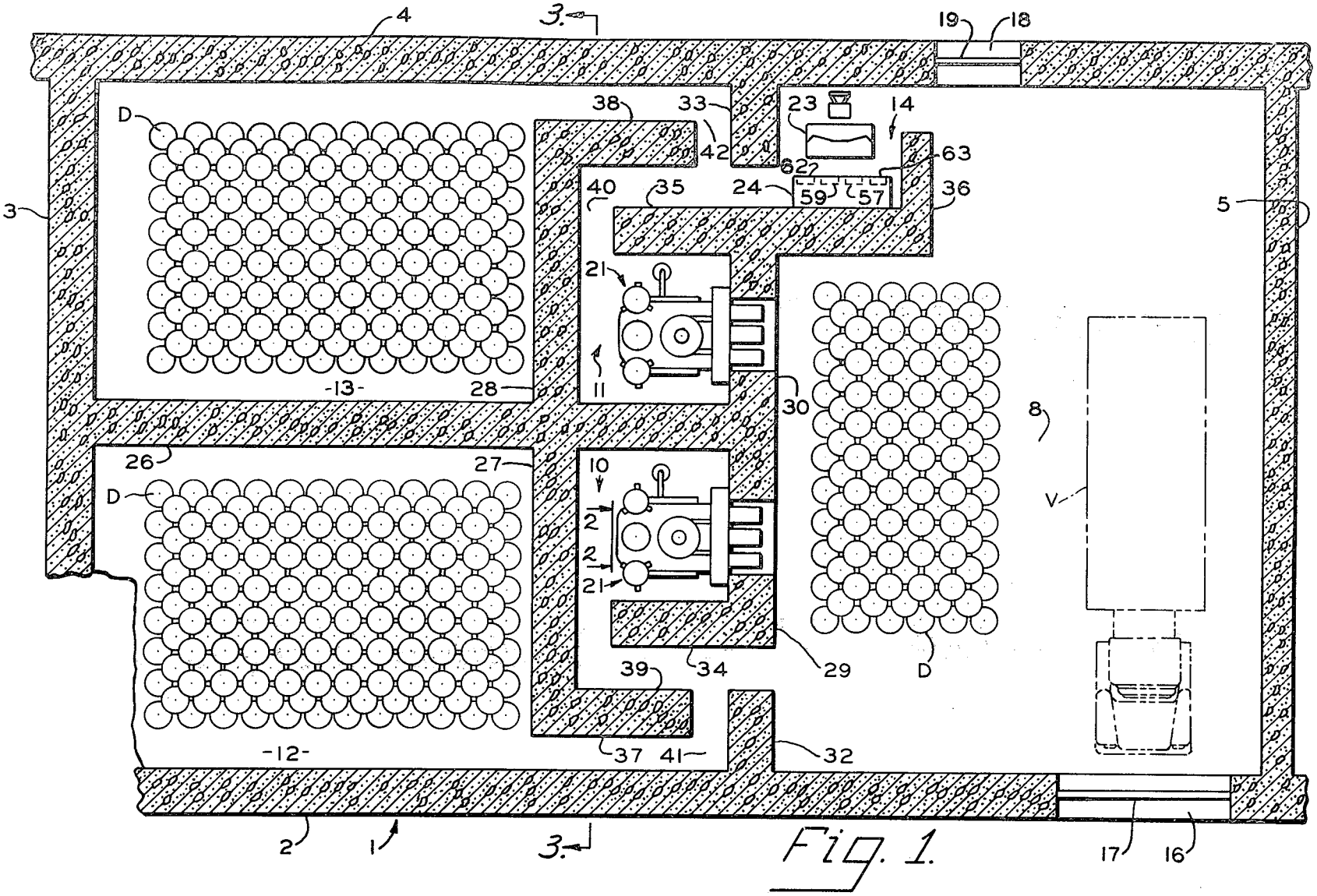
FIG. 1 is a plan section of a building and internal equipment for handling radioactive waste material, the scale being much smaller than full size.

For illustrative purposes, the below described embodiment of the invention will be described in connection with the disposition of radioactive waste material in the form of resin particles containing radioactive materials like those described above, and in the form of evaporator bottoms, by putting the radioactive material including water, and cement as a solidifying agent, into a steel drum; mixing these materials in the drum; moving the drum into storage; allowing the mixture to solidify and radioactivity to decay in storage; and then moving the drum to a vehicle for transportation.

For convenience, the term "drum" is used hereafter to designate steel drums or barrels as such, as well as suitable other types of containers for the indicated purposes.

The reference numerals used herein and the terminology employed correspond to those used in said copending application Ser. No. 182,088, the entire disclosure of which is hereby incorporated by reference and made a part of the disclosure of the present application.

The equipment generally shown in FIG. 1 comprises a building 1 of rectangular configuration in plan, of which building upright walls 2, 3, 4 and 5, the ceiling and the floor are preferably formed of poured reinforced concrete, of sufficient thickness to present escape of harmful radiation from the interior of the building. The building interior is subdivided into an area 8, two drumming stations 10 and 11, two storage vaults or decay pits 12 and 13, and a control station 14.

The control station includes a control console 23 at which the operator will sit and from which he can control the operation of the apparatus by remote control. The control station also includes unit 24 spaced rearwardly from the control console and containing other apparatus and the television monitor screens 57, 59, 62 and 63.

Area 8, which is free of radioactive materials or radioactivity at all times except temporarily when radioactive materials are being shipped from the building, is shown as used for storage of non-radioactive materials such as drums D that contain no radioactive materials but may, and in this illustrative embodiment do, contain accurately weighed preloaded amounts of cement as a solidifying agent. The area 8 has in wall 2 a vehicle doorway 16 having a door 17 which may be of conventional automatically controlled type. A personnel doorway 18, having a conventional door 19, is in wall 4 near station 14.

Each drumming station 10 and 11 is equipped as described below, with apparatus 21, operable by remote control from apparatus 23, 24 in operator control station 14, for introducing radioactive materials and water into drums D, each preloaded with accurately determined amounts of dry cement as a solidifying agent, all in proper proportions to permit these materials after thorough mixing to form in the drum a solid body of controlled weight, and for then thoroughly mixing these ingredients.

A drum D containing the resulting mixed radioactive material, cement and water may then be stored in a storage vault 12 or 13 to permit solidification of drum contents and decay of radiation until its intensity is reduced to shipable limits.

A drum D is picked up from area 8, put into a selected drumming station 10 or 11 then after proper filling and mixing moved if desired into a selected storage vault 12 or 13; and when desired moved onto vehicle V by remotely controlled overhead crane apparatus.

These operations are performed by remote control without actual visual access, the operations being viewed through television screens and monitored by other means described below.

Building

The interior of the building 1 is subdivided (FIGS. 1, 2, 3) into the storage vaults 12 and 13 by a thick center interior wall 26 and transverse end walls 27 and 28 that are joined to wall 26 and extend into relatively close proximity to but stop short of exterior side walls 2 and 4. Transverse walls 29 and 30 longitudinally spaced from interior walls 26 and 27, and stub walls 32 and 33 joined to outer side walls 2 and 3 and spaced from transverse walls 39 and 30 set off the area 8 and station 14 from the vaults and drumming station. Spaced transverse walls 27 and 29, and 38 and 30 together with a portion of center wall 26 and longitudinally extending intermediate stub walls 34 and 35 define the drumming stations 10 and 11.

And extension of wall 35 and a short transverse wall 36 joined to it define the operator station 14.

Walls 34 and 35 together with overlapping longitudinal wall portions 37 and 38 respectively fixed to transverse walls 27 and 28 and respectively spaced from walls 2 and 34 and from walls 4 and 35, together with the transverse walls 27 and 28 and walls 32 and 33, define labyrinthian passages 39, 40, 41 and 42 that prevent lateral escape of radiation from storage vaults 12 and 13 and the drumming stations 10 and 11 into area 8 and control station 14, while permitting access to the drumming station and vaults during construction and later if necessary.

Drumming Station:

General Arrangement of Drumming Station

The apparatus in each drumming station comprises substantially the same four basic components: a metal shield wall 214, drumming equipment 215, a decanting tank 216 and a set of metering pumps 217*a, b, c*.

Shield Wall

The shield wall 214 serves as a locating and anchoring means for the other components 215, 216, 217*a, b, c*. It is formed of strong metal to support the other components and to serve as a barrier to stop the escape of harmful radiation from the side of the shield wall carrying these components, to the other side.

The shield wall is rigidly but demountably attached to the concrete building wall 29 or 30 by an accurately machined, grouted in frame 218 (FIGS. 3, 4) surrounding wall opening 219 to which the shield wall is secured by bolts and nuts 220 on the safe side of the shield wall. Preferably, the shield wall has a supporting eye 221 at its top.

Figure 3:
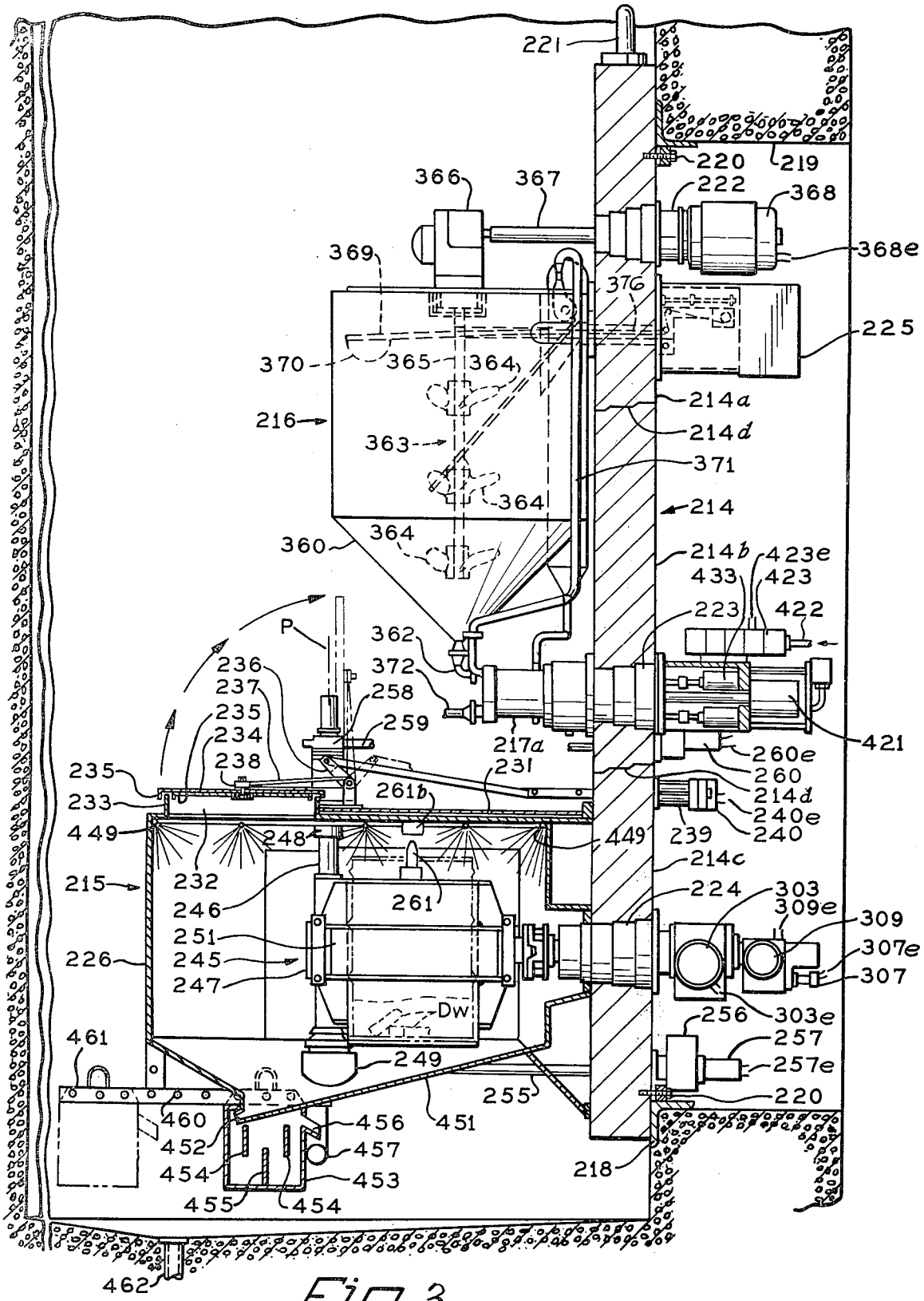
FIG. 3 is a side view of the drumming apparatus, parts being broken away to show the interior mechanism in the housing.
Figure 4:
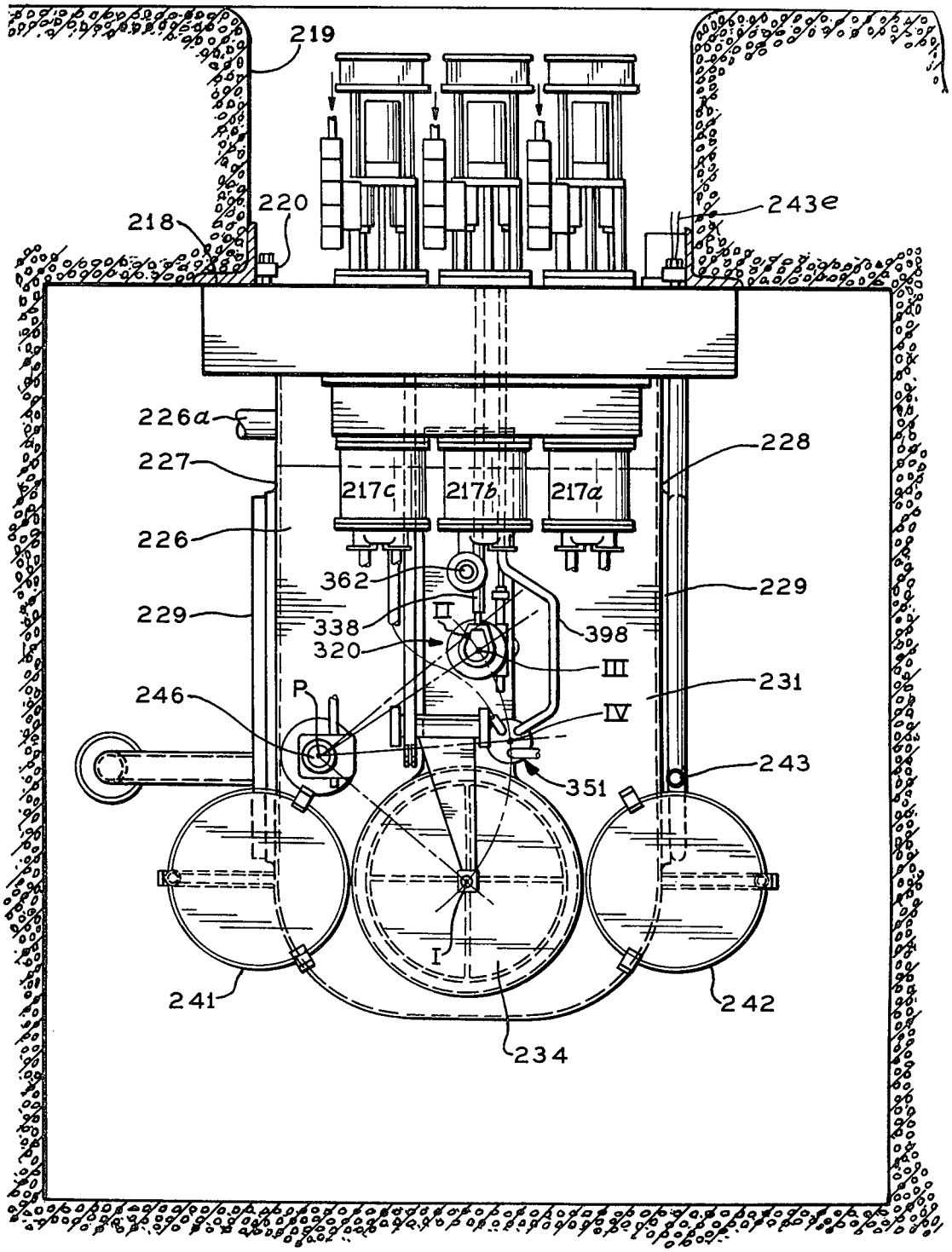
FIG. 4 is a plan view along line 4—4 of FIG. 2 and to a somewhat larger scale, parts being omitted for the sake of clearness.
Figure 5:
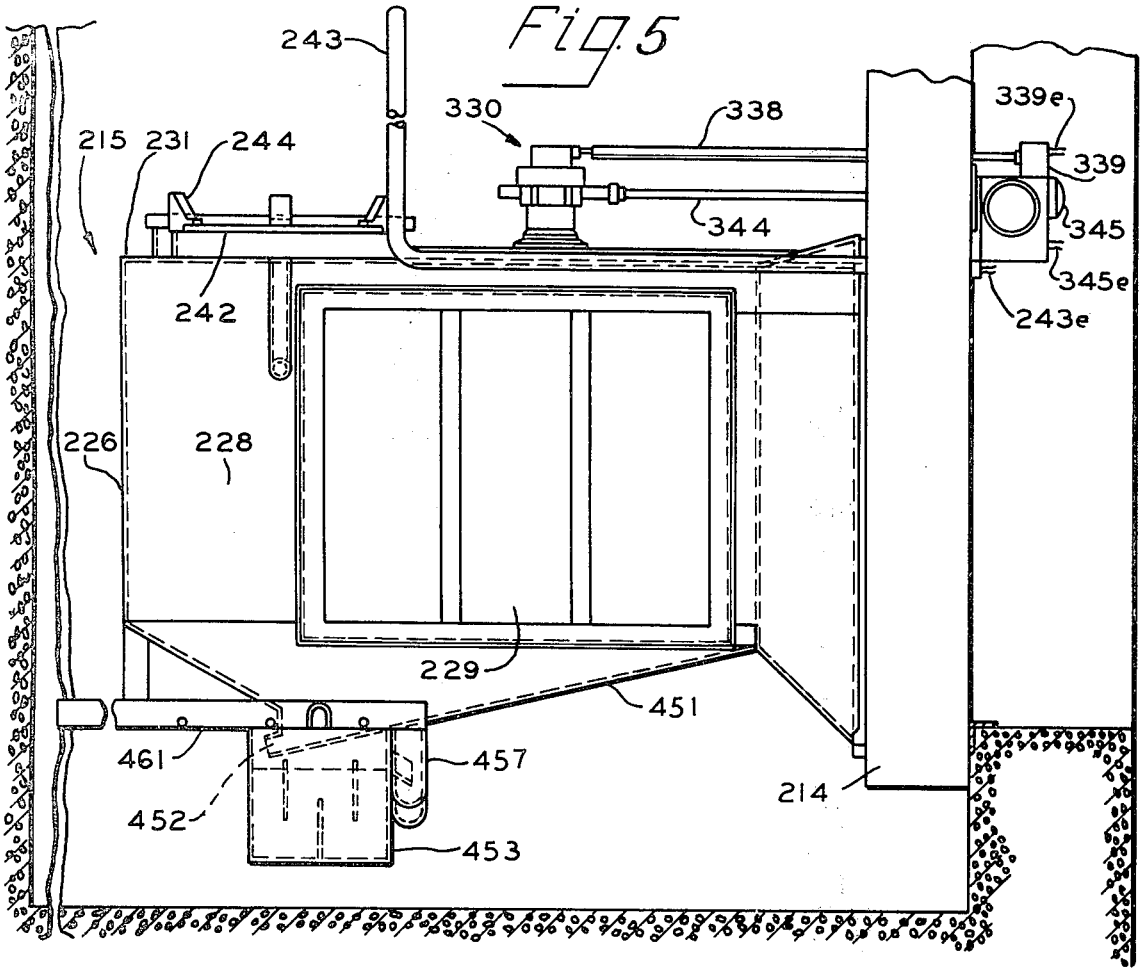
FIG. 5 is a side elevation of the lower portion of the drumming apparatus, in general corresponding to the side elevation of FIG. 4.
Figure 7:
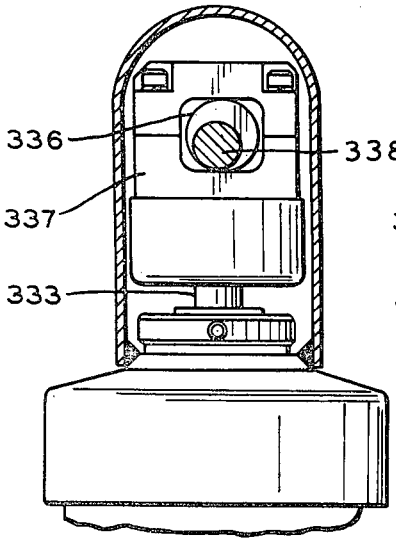
FIG. 7 is a section along line 7—7 of FIG. 6.
Figure 8:
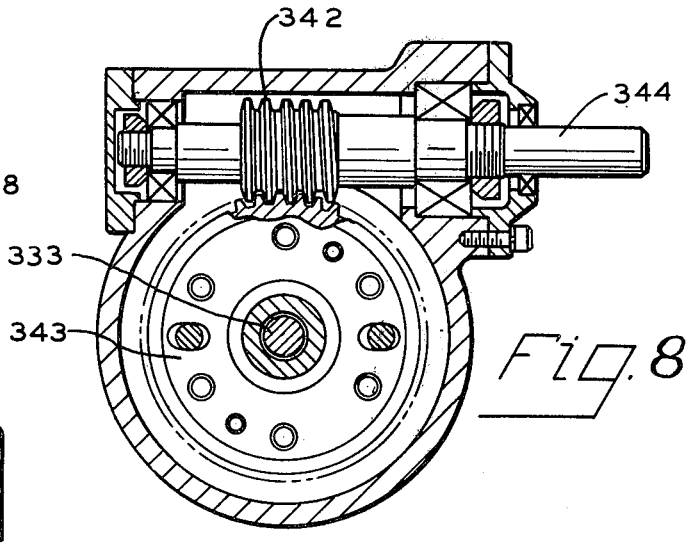
FIG. 8 is a section along line 8—8 of FIG. 6.

The shield wall may be divided into section 214*a*, 214*b*, 214*c*, by transverse joints 214*d* to facilitate easier handling and shipping. These joints are offset or stepped as shown in FIG. 3 to prevent radiation leakage outwardly to the safe side of the shield wall outside of the drumming station.

Drumming Equipment

The drumming equipment 215 illustrated comprises a closed housing 226 supported from the side of the shield wall facing into the drumming station. This housing (FIGS. 2–5) has upstanding sides 227, 228 carrying detachably mounted access plates 229. The top 231 of the housing has a hatch opening 232 surrounded by upward flange 233, closed by a hinged hatch cover 234 having inner and outer downward flanges 235 that overlap flange 233 in the closed position to prevent escape of radioactive material. The housing and hatch cover when closed provide a closed enclosure in which drum loading and mixing occurs. Hatch cover 234 can be moved to closed and open positions by a lever 236 pivotally supported on housing 226 and is rigidly secured to an arm 237 carrying the hatch cover through a resilient connection 238. Lever 236 is actuated from the safe side of the shield wall by a known fluid-operated cylinder 239, the fluid valves 240 of which are controlled by known means 240*e* from the control station 14. Housing 226 has a venting conduit 226*a* preferably connected to a closed venting system.

A fixed loading dock 241 is externally mounted at one side of the housing 226 and is adapted to support a drum to be filled that is first deposited by the crane on this dock. A fixed unloading dock 242 is externally mounted on the other side of housing 226; a drum removed from housing 226 is set by the crane of this unloading dock, and that intensity of radiation emanating from the drum is measured by known radiation monitor means 243 that sends a known means 243*e* electrical signals to the control station 14. Each of the loading and unloading docks carries a scale 244.

Inside of drumming equipment 215 is a drum positioner cradle mechanism 245 adapted to carry a drum and move it (FIG. 4) about a vertical axis P from a drum loading and unloading position "I," then to a first intermediate position "II" in which the drum is clamped into its cradle in a vertical position, then to a second intermediate position "III" in which the drum is opened by unscrewing and removing its cap, then to a third intermediate position "IV" where the drum is filled then back to intermediate position "III" in which the drum is closed or capped, then to intermediate position "II" where the drum is turned end-over-end to agitate and mix its contents, from which position the cradle returns the drum to location "I" under the hatch from where the drum can be removed by grab 53. The cradle mechanism comprises a vertical shaft 246 (FIGS. 2–4) on which a cradle frame 247 is rigidly mounted; the shaft is rotatably and vertically slidably mounted in bearings 248, 249 mounted at the top and bottom of housing 226. A cradle 251 rotatably supported in the cradle frame by bearing for rotation about a horizontal axis on its cradle frame which thus forms a trunnion in which the cradle can be rotated to impart to the drum the desired end-over-end motion to thoroughly mix the contents of the drum, tumbling movement of the loose mixing weights Dw (FIG. 3) in the drum aiding this mixing.

The cradle frame 247 is moved to angular positions I, II, III, IV indicated above by actuating means (FIGS. 2, 3) comprising a lever arm 254 rigidly mounted on the lower end of shaft 246 and pivotally connected to a rod 255 that may be reciprocated as required by a known mechanism 256 driven from an electric motor 257 energization of which is controlled by known means 257*e* from control station 14. The linear travel provided by mechanism 256 may be controlled by known means accurately to stop the cradle in the various angular positions as described above.

The cradle frame 247, its supporting shaft 246 and cradle 251 carrying a drum can be raised and lowered as required to permit movement of the cradle and performance of necessary steps in the positions I–IV, by a known type of screw jack mechanism 258 (FIGS. 2, 3, 4) actuated by a drive shaft 259 extending through the shield wall to its safe side. Shaft 259 is rotated as required by a gear box electric motor combination 260, controlled by known means 260*e* from the control station to raise the cradle to an upper elevation referred hereafter as the "U" elevation in positions III and IV, and to lower the cradle to a lower elevation hereinafter referred to as the "L" elevation for movement between the positions and for operating in positions I and II.

Figures 6, 9:
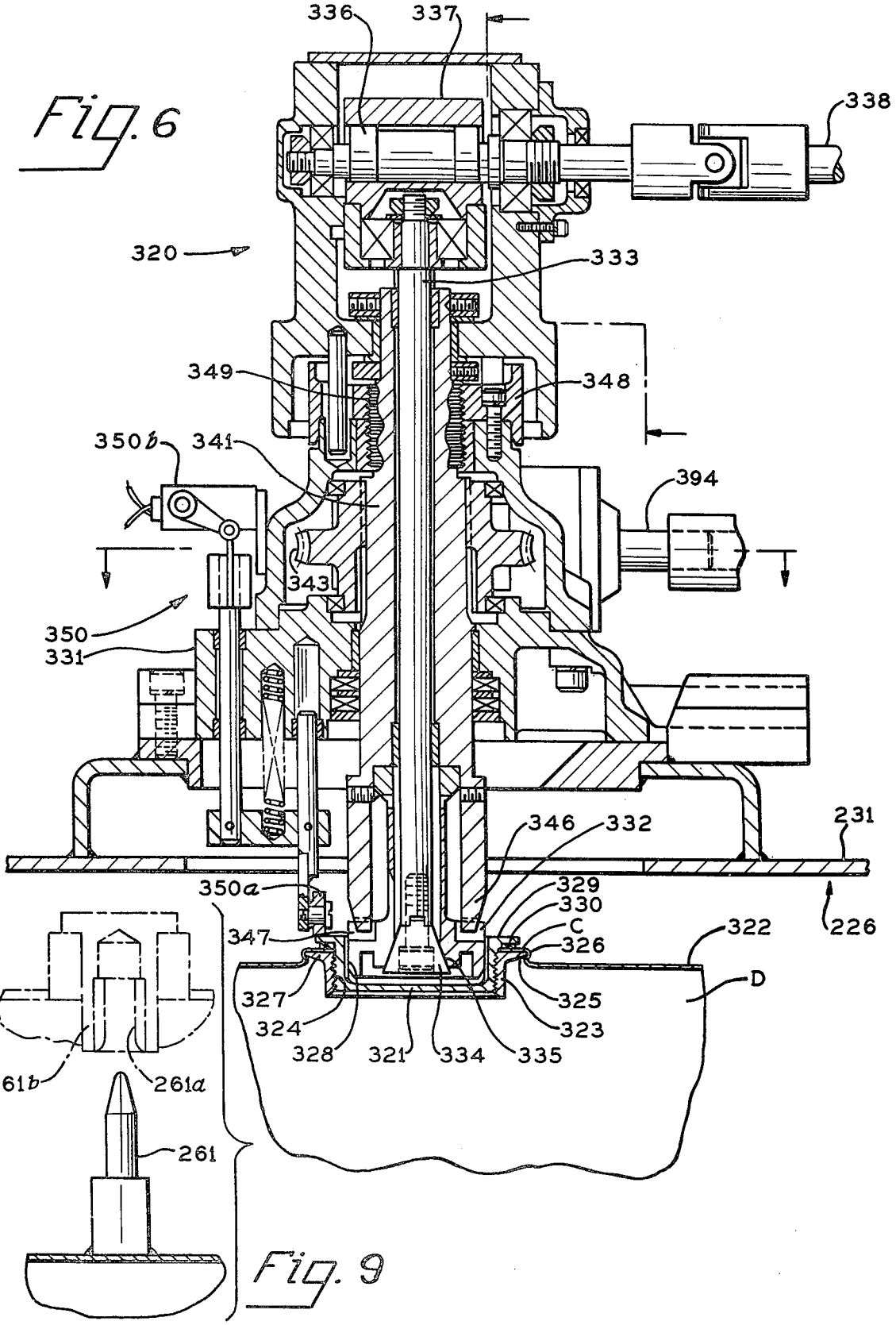
FIG. 6 is a section through the cap-handling means for screwing and unscrewing a cap of a drum, the scale being considerably larger than that of FIGS. 2 to 5.
FIG. 9 is a detail to a larger scale showing means for securing the cradle frame in the desired elevated position during the capping operations.

When the cradle frame 247 is raised to elevation U in either of positions III or IV, an upwardly projecting tapered dowel pin 261 (FIGS. 3, 9) fixed to the top of the cradle frame engages in the opening 261*a* of the appropriate one of two hardened steel bushings 261*b* in the top wall 231 of the housing 226. This assures accurate and positive location of the cradle in positions III and IV for the filling and capping operations that are carried out in these positions.

Power means are provided for rotating the cradle when it is in position II including an electric motor 303 (FIG. 3) controlled by known means 303*e* from control station 14.

Axially movable means are provided for actuating the clamping arms including a double acting fluid operated power cylinder 307, and rotatable means are provided to clamp or unclamp the drum including an electric motor 309 (FIG. 3). The cylinder 307 and motor 309 are controlled by conventional means 307*e* and 309*e* from station 14.

The drumming station also includes cap handling means 320 for removing and replacing a screw cap 321 in the top of a drum, (FIGS. 5–8). After the drum is at position III for cap removal, the cradle frame 247 is raised to elevation U to raise the drum D carried by the cradle 251 so its cap 321 can be engaged by means 320.

When brought into the drumming station according to the illustrative process, each drum will contain a preloaded accurately determined amount of cement or other solidifying agent and one or more freely movable mixing weights Dw which may take the form of oblong pieces of steel; a cap 321 closes the drum.

The drum, which is of generally cylindrical form, has (FIG. 6) a cap opening structure C at the center of the top wall 322 of the drum, comprising a steel collar 323 having an internal threaded opening 324, fixed in the top wall 322 of the drum. Collar 323 has a radial flange 325 around the outer edge of which the top wall metal is crimped at 326 to hold the collar securely in the drum; preferably a sealing ring 327 is clamped between the drum metal and the flange 325 to provide a fluid-tight seal between the collar and the drum. The internally threaded opening 324 is adapted to be closed by cap 321 that has an external thread that permits the cap to be screwed into the threaded opening. The cap has a central depression 328 of circular cross section with vertical serrations or other suitable gripping surface, and an outward radial flange 329; cap 321 also carries a sealing ring 330 that forms a fluid-tight seal between the cap and the drum.

Cap handling means 320 comprises frame structure 331 rigidly mounted on housing 226, and a wrench 322 rotatably and axially movably supported on the structure 331 to grasp and remove and replace cap 321. The wrench is a resilient expandable slotted collet that is resiliently biased to contract and has an outer surface shaped to fit inside depression 328 of the cap so that when the collet is expanded it firmly grasps the inner wall of the depression. The wrench is expanded by a pull rod 333 having an externally conical expanding portion 334 that bears against a matching internally conical surface 335 in the wrench, so that when the pull rod is drawn upwardly it expands the wrench to grasp the cap.

The pull rod is drawn upwardly and moved downwardly as required by a cam 336 (FIGS. 7, 8) that is rotated about its horizontal axis to lift and lower a follower 337 that is slidably mounted on frame structure 331, and supports the pull rod for rotatable but no relative axial movement. The cam is connected to and rotated (FIGS. 4–6) by a shaft 338 that extends through shield wall 215 to a gearbox and electric motor unit 339 the motor being controllable by conventional means 339*e* from the station 14. The cam is shaped to provide a predetermined amount of tension on the pull rod and collet wrench 332 to permit the cap to be gripped with adequate force to hold it securely for removal, but not to deform it. When the cam 336 is turned so it moves the cam follower down, rod 333 is lowered, thus moving its conical portion 334 downwardly of the collet wrench and allowing the wrench to contract to release the cap.

While the wrench is engaged in the cap, the cap is rotated by the cap handling means 320 to unscrew the cap to open the drum, and after the radioactive material has been placed in the drum to screw the cap in the drum to close it. For this purpose a hollow shaft 341 surrounds and is coaxial with the wrench pull rod and is adapted to support and rotate wrench 332. It is supported from frame structure 331 for rotational and axial movement correlated with the pitch of the threads of cap 321 and opening 324. The shaft 341 is rotated by a worm gear 342 that drives a worm wheel 343 rotatably but axially immovably supported from frame 331.

It is rotated (FIGS. 5, 6, 8) as required by a shaft 344 extending through the shield wall to a gearbox and electric motor unit 345 controlled from station 14 by means 345*e*.

Shaft 341 is slidably but non-rotatably connected to worm gear 343 and has projecting dogs 346 at its lower end that engage shoulders 347 on the wrench 332 to rotate it when shaft 341 is rotated. Vertical travel of the wrench shaft and wrench are correlated with axial movement of the cap as it screws in or out by a nut 348 rigidly carried by frame 331 engaging a lead screw 349 fixed to shaft 341, the nut and lead screw having threads of the same linear pitch as the thread on the drum and cap, so as to retain exact relationship between threads in the drum and on the cap to facilitate recapping without cross-threading. The cap handling means is so designed that cam 336 maintains and holds tension on the pull rod that cause the wrench to grasp and firmly hold the cap during the removal of the cap and in the interim period while the drum is being filled. Sensing means 350 embodying spring loaded feeler 350*a* and limit switch 350*b* senses when the drum is in the proper position to have the cap removed or inserted, and through interlock means permits the apparatus 320 to operate; otherwise it prevents operation.

After the cap has been removed at position III the drum is ready to have the radioactive material put in it. This is accomplished by locating the drum carrying cradle 251 in the filling position IV and lifting the cradle and drum to engage the opening 324 with the fill nozzle 351 (FIG. 4) in the top wall 231 of housing 226.

Operation of Drumming Station

A typical cycle of operations of the drumming station is as follows, assuming that the cradle frame 247 is located so its cradle 251 is properly located in position I under the hatch cover 234, the cradle being positioned in the cradle frame to receive a drum in the vertical position; the hatch cover 234 is open; and a capped drum D containing cement and mixing weights Dw is on the loading dock 241 of the drumming station to be operated as shown in broken lines in FIG. 2. The operator in control station 14 then controls the overhead crane and its drum grab to pick up the drum from the loading dock and load it into the cradle. The operator then causes the hatch cover to close and the cradle frame 247 to move to position II. The clamping members are then actuated to clamp the drum. The cradle frame is then angularly moved to locate the drum at position III for cap removal. The cradle frame is then raised to cause its pin 261 to enter the socket 261*a* for position III, and to raise the drum so its cap 231 can be engaged by the wrench 332 of cap handling means 320, which is then caused to operate to remove the drum cap. The cradle frame 247 is then lowered, and moved angularly to the drum filling position IV.

The cradle frame is here raised to cause its pin 261 to enter the socket 261*a* for position III, and to raise the drum so the fill nozzle 351 extends into the drum. The filling cycle is then carried out as described previously by supplying a metered amount of a dispersion of radioactive particles in water from decanting tank 216 or from evaporator bottoms supply line 445.

After the proper predetermined amount of the dispersion of radioactive particles in the proper proportion of water has been put into the drum, the cradle frame is then lowered and moved angularly to the capping position III where the cradle frame will again raise the drum so it is in capping relation to the cap in a position so that when rotated the cap moves downwardly and engages the threads of the drum. The cap is then reinserted and screwed tight as described above. The wrench of the cap handling means is then released and the cradle frame lowered.

The cradle frame is next moved to position II to locate the closed drum for mixing. The drive motor 303 for rotating the cradle is the restarted and the drum is rotated end-over-end to mix the drum contents thoroughly, the freely movable mixing weights Dw in the drum greatly aiding thorough mixing. During the later part of the mixing cycle, the drum may be washed as it is rotating by water sprayed from heads 449 so that drum and the interior of the drum housing 226 can be thoroughly washed down. When the mixing cycle has been completed, the mixer stops with the drum in an upright veritical position as described. Thereafter the cradle frame is released from the housing so that it may be angularly moved to position I for unloading.

Hatch cover 234 is then opened and drum grab lowered through the hatch into the housing 226 to pick up the drum. The drum is then placed on the unloading dock 242 where its weight is checked by scale 244 and its radiation level is monitored by monitor 243.

Figure 2:
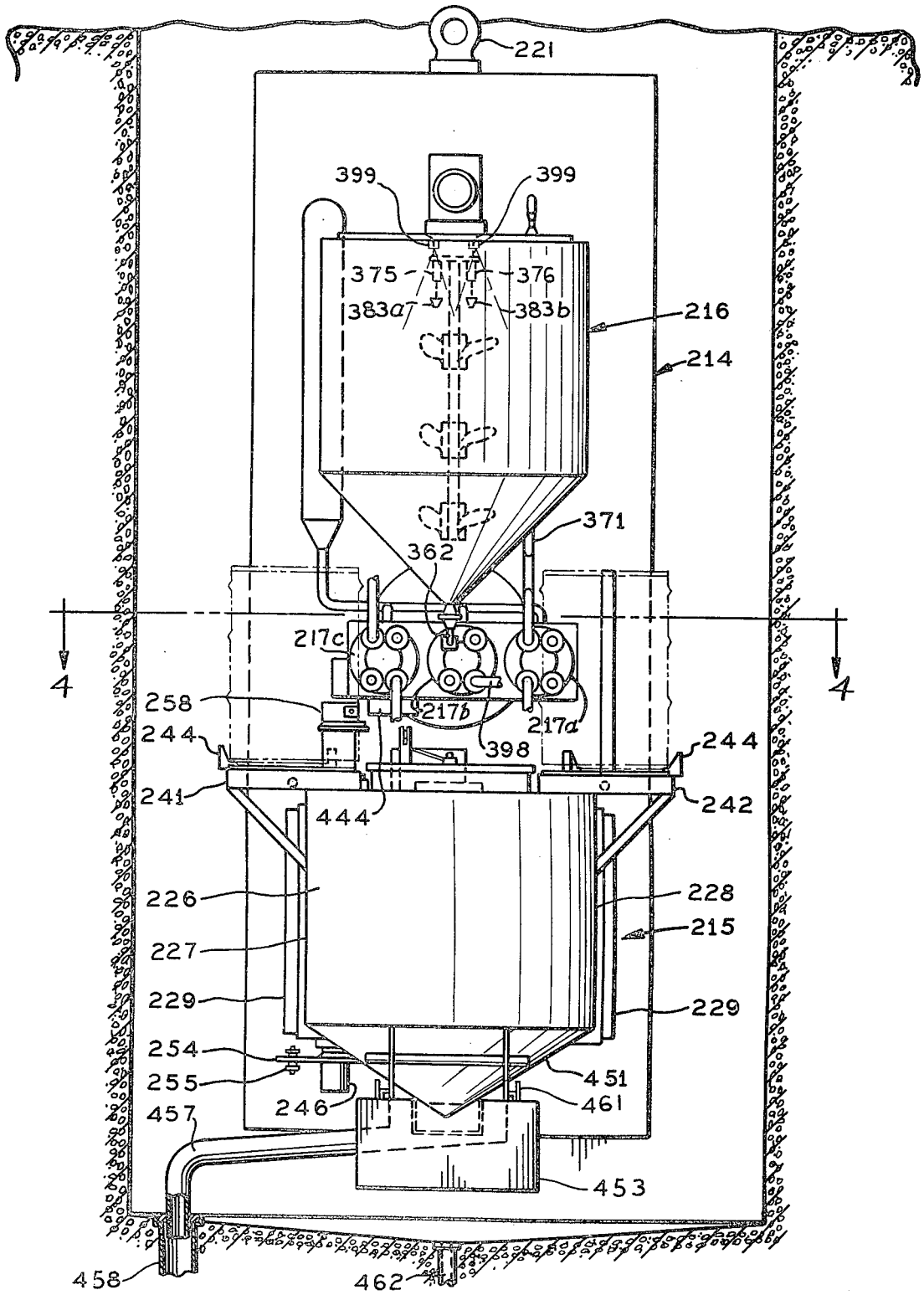
FIG. 2 is a view of drumming apparatus in the drumming station, from line 2—2 of FIG. 1 and to a scale considerably larger than that of FIG. 1.

The operator places another drum with its predetermined quantity of dry cement on the loading dock 241 as shown in FIG. 2 while the drum being filled is in housing 226 in its filling cycle. The scale 244 on the loading dock is used to verify the cement quantity in the drum, and the drumming apparatus is ready for the next cycle.

After the operator loads the next drum into the cradle and starts the drumming cycle, he then places the processed drum in one of the decay vaults 12, 13 for storage and brings another drum into position on the loading dock. Modifications may be made in this illustrative process of operations.

Various modifications may be made in the apparatus or process disclosed, and other modifications, advantages, and modes of operation will become apparent without departing from the spirit of the invention.

We claim;

1. Apparatus for placing a closure means having a helical thread at an opening of an object which opening has an axis and a coaxial matching helical thread at said opening adapted to have screwed onto it the thread of said closure means when said closure means is placed at said opening, which closure means has grasp means by which said closure means may be grasped at essentially any location about its axis, said apparatus comprising wrench means adapted to be actuated to positively engage said grasp means at essentially any location about its axis to firmly grasp said closure means and adapted to be actuated to positively disengage said wrench means from said grasp means to release said closure means; shaft means carrying said wrench means, said shaft means having a helical thread of the same pitch as said threads of said closure means and said opening; means) for supporting said shaft means and said wrench means for rotation and for movement of said wrench means toward and away from said opening, said supporting means including means having a helical thread matching and engaging the thread of said shaft means, said helically threaded supporting means being immovable relative to said object while said wrench means is actuated to engage the grasp and unscrew said closure means from said opening and while said shaft means and wrench means are being rotated; means for rotating said shaft means to cause said wrench means to move axially and to rotate; and means associated with said wrench means for actuating said wrench means to positively engage it with said grasp means of said closure means to grasp said closure means, and to positively disengage it from said grasp means to release said closure means.

2. The apparatus of claim 1 in which said means for rotating said shaft means to move said wrench means is adapted to move said wrench means along said axis toward said opening in said object which has a closure means screwed onto said thread at said opening until said wrench means can engage said grasp means of said closure means to grasp said closure means; and in which said means for rotating said shaft means is adapted to move said wrench means along said axis and rotate said wrench means so that it moves said wrench means in the direction to unscrew the thread of said closure means, while it is grasped by said wrench means, from said thread at said opening and to move said closure means away from said opening.

3. The apparatus of claim 2 in which said means for rotating said shaft means carrying said wrench means is adapted to move said wrench means along said axis toward said opening in said object while said wrench means grasps said closure means, until said thread on said closure means engages said thread at said opening at the same relative locations of said threads at which said threads of said closure means left the threads at said opening during said unscrewing operation; and to continue said axial movement and rotation of said wrench means while it grasps said closure means until the thread of said closure means is screwed onto the thread of said opening and said closure means closes said opening; in which said means for actuating said wrench means thereafter actuates it to disengage it from said grasp means of said closure means to release said closure means; and in which said means for rotating said shaft means moves said wrench means axially away from said closure means while it is free of said closure means.

4. The apparatus of claim 1 in which said means for rotating said shaft means carrying said wrench means is adapted to move said wrench means along said axis toward said opening in said object which has a closure means screwed onto said thread at said opening until said wrench means can engage said grasp means of said closure means and grasp said closure means; in which said means for rotating said shaft means is adapted to move said wrench means along said axis and rotate said wrench means so it moves said wrench means in a direction to unscrew the thread of said closure means while it is grasped by said wrench means, from said thread at said opening and to move said closure means away from said opening; in which said means for rotating said shaft means is adapted to move said wrench means along said axis while said wrench means grasps said closure means toward said opening in said object until said thread on said closure means engages said thread at said opening and to continue said axial movement and rotation of said wrench means while it grasps said closure means until the thread of said closure means is screwed onto the thread of said opening and said closure means closes said opening; in which said means for actuating said wrench means actuates it to disengage it from said grasp means on said closure means to release said closure means; and in which said shaft means moves said wrench means axially away from said closure means while it is free of said closure means.

5. The apparatus of claim 1 in which said means for supporting said shaft means and wrench means for rotation and movement toward and away from said opening provides an axial movement per revolution of said wrench means comparable to the pitch of the threads on said opening and said closure means.

6. The apparatus of claim 2 in which said means for supporting said shaft means and wrench means for rotation and movement toward and away from said opening provides an axial movement per revolution of said wrench means comparable to the pitch of the threads on said opening and said closure means.

7. The apparatus of claim 3 in which said means for supporting said shaft means and wrench means for rotation movement toward and away from said opening provides an axial movement per revolution of said wrench means comparable to the pitch of the threads on said opening and said closure means.

8. The apparatus of claim 4 in which said means for supporting said shaft means and wrench means for rotation and movement toward and away from said opening provides an axial movement per revolution of said wrench means comparable to the pitch of the threads on said opening and said closure means.

9. The apparatus of claim 1 in which said closure means has an external thread thereon and said opening has a matching internal thread therein.

10. The apparatus of claim 1 in which said means for rotating said shaft means and said wrench means is adapted to move said wrench means in opposite directions, and in which means are provided to indicate the position of said opening relative to said wrench means.

11. The apparatus of claim 1 in which said wrench means includes movable means capable of being moved to positively engage said grasp means of said closure means at essentially any location about said axis of said closure means and capable of being retracted to positively disengage from said grasp means of said closure means, and means for so moving said movable means.

12. The apparatus of claim 1 in which said means for supporting said shaft means and said wrench means includes means providing axial movement per revolution of said wrench means equivalent to the pitch of the threads on said closure means and at said opening, and in which said means for moving said wrench means causes said wrench means when grasping said closure means to move to unscrew said closure means and move away from said opening to remove said closure means away from said opening, and thereafter to move said closure means toward said opening and screw it on the thread at said opening at the same relative locations of said threads at which said thread of said closure means left the thread at said opening during the unscrewing operation.

13. The apparatus of claim 1 in which said wrench means comprises a plurality of members movable toward and away from said axis to retracted and expanded positions, in one of which positions said movable members positively grasp said grasp means of said closure means and in the other of which positions said movable members are positively disengaged from said grasp means of said closure member and operating shaft means with said shaft means carrying said wrench means so that by movement of said operating shaft means relative to said shaft means carrying said wrench means said operating shaft means can move said movable closure grasping members between their retracted and extended positions.

14. Apparatus for placing a closure means having a thread at an opening of an object which has an axis on a coaxial thread at said opening adapted to be engaged by the thread of said closure means, which closure means has grasp means by which said closure means may be grasped, said apparatus comprising wrench means adapted to engage said grasp means to grasp said closure means and adapt it to be actuated to disengage said wrench means from said grasp means to release said closure means; and means for moving said wrench means along the axis of said opening while rotating said wrench means to provide an axial movement per revolution equivalent to the pitch of the threads of said threads of said closure means and at said opening, said means being adapted to move said wrench means toward said opening to a position where said wrench means can grasp said grasp means of said closure means, unscrew said closure means from said opening, remove said closure means from said opening to permit access to said opening, return said closure means to said opening and engage the threads of said closure means and said opening in the same relative positions at which said threads separated when said closure means was unscrewed from said opening and screw said closure means on said thread at said opening to close said opening, and move away from said closure means after said wrench means releases said closure means, said means for moving said wrench means acting to restrict said movement of said wrench means only to said movement along the axis of said opening while rotating said wrench means to provide an axial movement per revolution equivalent to the pitch of the threads of said closure means and at said opening; and means for actuating said wrench means to release said closure means.

15. Apparatus for placing a closure means having a thread at an opening of a container which opening has an axis and a coaxial thread at said opening adapted to be engaged by the thread of said closure means, which closure means has grasping means by which said closure means may be grasped, said apparatus comprising wrench means adapted to engage said grasp means to grasp said closure means and adapted to be actuated to disengage said wrench means from said grasp means to release said closure means; and means for moving said wrench means along the axis of said opening while rotating said wrench means to provide axial movement per revolution of said wrench means equivalent to the pitch of the threads of said closure means and at said opening, said means being adapted to move said wrench means towards said opening to a position where said wrench means can grasp said grasping means of said closure means, to unscrew said closure means from said thread at said opening, to remove said closure means from said opening to permit access to said opening, to return said closure means to said opening and screw said closure means on said thread at said opening to close said opening, and to move away from said closure means after said wrench means releases said closure means; means for actuating said wrench means to release said closure means; and means for supporting said container in a predetermined position relative to said wrench means during unscrewing of said closure means, for moving said container to a different location relative to said wrench means, and for returning said container to the same predetermined position relative to said wrench means for screwing on of said closure means.

16. Apparatus for placing a closure means having a thread at an opening of a container which opening has an axis and a coaxial thread at said opening adapted to be engaged by the thread of said closure means, which closure means has grasp means by which said closure means may be grasped, said apparatus comprising wrench means adapted to engage said grasp means to grasp said closure means and adapted to be actuated to disengage said wrench means from said grasp means to release said closure means; means for supporting said wrench means for rotation and for movement toward and away from said opening, said supporting means providing axial movement per revolution of said wrench means equivalent to the pitch of the threads of said closure means and at said opening, means for moving said wrench means to cause it to move axially and to rotate, said means causing said wrench means when grasping said closure means to move to unscrew said closure means and move away from said opening to remove said closure means away from said opening, and thereafter to move said closure means toward said opening and screw it on the thread at said opening at the same relative locations of said threads at which said thread of said closure means left the thread at said opening during the unscrewing operation; means associated with said wrench means for actuating said wrench means to positively disengage it from said grasp means of said closure means to release said closure means; and means for supporting said container in a predetermined position relative to said wrench means in which position said wrench means can unscrew said closure means during the unscrewing operation, for moving said container to a different location relative to said wrench means, and for returning said container to the same predetermined position relative to said wrench means for screwing on of said closure means.

17. In an apparatus for introducing material into a container having a wall portion with an opening to receive said material and having a thread at said opening and a closure means with a thread matching the thread at said opening, said closure means having grasp means by which it may be grasped and turned, the combination comprising supporting means at a fixed location; wrench means carried by said supporting means at said fixed location and adapted to engage said grasp means of said closure means when said opening is in a predetermined position relative to said supporting means at said fixed location; movable supporting means for supporting said container with said opening substantially at said predetermined position; locating means for accurately locating said wall portion of said container with said opening of said container and for holding said opening in said predetermined position relative to said supporting means at said fixed location after said container has been moved substantially to that position by said movable supporting means; means for moving said wrench means relative to said supporting means at said fixed location and while said opening is so held in said predetermined position by moving said wrench means toward said opening so said wrench means can engage and grasp said grasp means of said closure means and by rotating said wrench means to unscrew said closure means from said opening and move it away from said container, by moving said wrench means toward said opening and rotating it to screw said closure means onto said thread at said opening to close said opening, and by moving said wrench means away from said container after said wrench means has released said closure means; means associated with said wrench means for actuating said wrench means to so grasp and release said closure means; and means for moving said movable supporting means to support said container with its opening substantially at said predetermined position while said wrench means unscrews said closure means from the container opening, for moving said container laterally to a different location relative to said wrench means, and for returning said container laterally so that its opening is at said same predetermined position relative to said wrench means for screwing on of said closure means.

18. The apparatus of claim 17 comprising means responsive to movement of said wall portion of the container to said predetermined position for indicating the position of said opening relative to said supporting means at said fixed location.

19. The apparatus of claim 17 comprising sensing means for preventing operation of said means for moving said wrench means when said opening is not located properly relative to said supporting means at said fixed location.

20. The apparatus of claim 19 in which said locating means guides said container to a predetermined position relative to said supporting means at said fixed location for removal and replacement of the closure means.

21. The apparatus of claim 12 in which said locating means is carried by said movable supporting means.

22. The apparatus of claim 17 in which said container has an end wall and a side wall and said opening is in a predetermined position relative to the side wall of the container.

23. The apparatus of claim 17 in which said means for moving said wrench means effects an axial movement per revolution comparable to the pitch of the thread at said opening.

24. The apparatus of claim 17 in which said locating means moves said wall portion of said container to said predetermined position in response to movement of the container relative to said supporting means at said fixed location.

25. The apparatus of claim 17 comprising filling means foı introducing said material through said opening and in which said movable supporting means moves the container to a predetermined filling position relative to said filling means.

* * * * *